US005994994A

United States Patent [19]

Ito et al.

[11] Patent Number: 5,994,994

[45] Date of Patent: Nov. 30, 1999

[54] FUSE

[75] Inventors: Hideo Ito; Tomohiro Shinzawa, both of Tokyo, Japan

[73] Assignee: Kabushiki Kaisha Sinzetto, Tokyo, Japan; A part interest

[21] Appl. No.: 09/142,273

[22] PCT Filed: Mar. 5, 1997

[86] PCT No.: PCT/JP97/00689

§ 371 Date: Sep. 3, 1998

§ 102(e) Date: Sep. 3, 1998

[87] PCT Pub. No.: WO97/33294

PCT Pub. Date: Sep. 12, 1997

[30] Foreign Application Priority Data

May 3, 1996 [JP] Japan ..... 8-047768

[51] Int. Cl.[6] ..... H01H 85/157; H01H 85/143; H01H 85/18

[52] U.S. Cl. ..... 337/248; 337/228; 337/231; 337/252

[58] Field of Search ..... 337/228, 229, 337/248, 227, 231, 252

[56] References Cited

U.S. PATENT DOCUMENTS 961,891 6/1910 Orelli ..... 337/234
1,121,876 12/1914 Schipper ..... 337/234
1,502,881 7/1924 Sandin ..... 337/250
2,168,153 8/1939 Brown ..... 337/234
2,929,900 3/1960 White ..... 337/246
3,275,772 9/1966 Neff ..... 337/247
4,346,362 8/1982 Feenan et al. ..... 337/248

FOREIGN PATENT DOCUMENTS 8-64106 8/1996 Japan .

*Primary Examiner*—Leo P. Picard
*Assistant Examiner*—Anatoly Vortman
*Attorney, Agent, or Firm*—Notaro & Michalos P.C.

[57] ABSTRACT

The present invention relates to a fuse for improving the reliability and facilitating automation the process and, in this fuse, an inner cap 14 is provided between a glass tube 12 and a cap terminal 13; a passage 22 for ventilating the inside of the glass tube 12 is provided between the inner cap 14 and the glass tube 12; an end portion 15*a* of the fuse element 15 is taken out between the cap terminal 13 and the inner cap 14 through an element insertion hole 14*b* formed on a bottom plate 14*a* of the inner cap 14 in order to electrically connect the end portion 15*a* with at least the cap terminal 13; and the cap terminal 13 is fixed to the inner cap 14.

11 Claims, 7 Drawing Sheets

FUSE

FIELD OF THE INVENTION

The present invention relates to a fuse. More particularly, the present invention relates to a reliable fuse which facilitates automation of the process.

BACKGROUND OF THE INVENTION

There is a tubular fuse as a safety device for protecting an electric circuit from an excess current. As shown in FIG. 11, a generally-used tubular fuse 1 is made up of a glass tube 2, a fuse element 3 arranged in the glass tube 2 along an axial line of the glass tube 2, and a pair of cap terminals 4 (only one side is shown) fitted on both ends of the glass tube 2. Both ends of the fuse element 3 protrude and are soldered to the outside of the glass tube 2 through element insertion holes 4*a* formed to the respective cap terminals 4. This causes the fuse element 3 to be directly supported in the center of the glass tube 2 by each cap terminal 4 with a predetermined gap between the fuse element 3 and the glass tube 2. It is to be noted that both end portions 3*a* (indicated by a two-dot long and two short dashes line in the drawing) of the fuse element 3 protruding from solder 5 after soldering are shaved off by using a knife or the like.

In this tubular fuse 1, however, the solder 5 is piled up on the surface of the cap terminal 4 to fix the cap terminal 4 and the fuse element 3 protruding from the element insertion hole 4*a,* which makes it difficult to automate the process and leads to the deteriorated productivity. That is, in case of external soldering, an advanced technique is required for soldering for maintaining the quality of the fuse. For example, if the solder is overflowed from the bottom to the outer peripheral surface of the cap, this can cause an imperfect contact with the fuse holder. Further, in order to obtain the sufficient strength, the soldering must be applied on the entire bottom surface of the cap around the element insertion hole 4*a* of the cap terminal 4 without making any unsoldered part. Furthermore, when the soldering is not finished in one time and a soldering iron is again put to cover the unsoldered or insufficient part, the hardened solder may be melted to loosen the fuse element 3. Only a skilled operator can, therefore, carry out the soldering and the automation is not realized so far. However, the soldering causes the poor working environment that may cause a flux or the like to be generated, leading to the shortage of operators.

In addition, since the soldering is so applied as to cover the element insertion hole 4*a* of the cap terminal 4, the melted solder may bring the air therein and a cavity may be generated inside the solder 5 and above the element insertion hole 4*a* in particular, thereby preventing a desired strength from being obtained. Detection of this cavity is hard by the visual test, and hence it does not give a serious question to fusion of the fuse caused by the usual excess current if such a cavity exists. However, if a short-circuit or the like occurs near the fuse and a large current flows to cause interruption, the element may explode to blow the solder into pieces and to cause jet of an arc flame or gas or emission of metal powder.

Moreover, since the soldering is performed with the glass tube 2 being erected in such a manner that the solder 5 is piled up from the top, the melted solder may run down from the element insertion hole 4*a* before being hardened to wrap the fuse element 3 therein, and the length of the exposed part of the fuse element 3, i.e., the fuse length may become unequal to give the irregularity to the pre-arcing time/current characteristic.

Additionally, as a tubular fuse enabling the automation of manufacture, there is one shown in FIG. 12. In this tubular fuse 6, both end portions of the fuse element 3 are externally bent along the edges of the glass tube 2 and sandwiched between the glass tube 2 and a cap terminal 7 to be fixed. According to this fuse structure, the fuse element 3 can be temporarily fixed by only fitting the cap terminal 7 and, if the solder 5 is piled up inside the cap terminal 7 in advance, the soldering can be effected by only heating in this state to fix the fuse element 3. Here, since the cap terminal 7 must be fitted with both the ends of the fuse element 3 being caught on the edges of the glass tube 2 and being stretched, the both ends are bent in the direction opposed to each other in the diameter direction. The fuse element 3 is, therefore, obliquely housed in the glass tube 2.

In this tubular fuse 6, however, the fuse element 3 directly contacts with and is obliquely supported by the glass tube 2, and hence the fuse element 3 may be brought into contact with the glass tube 2 in the vicinity of the edges of the glass tube. When the fuse element 3 is brought into contact with the glass tube 2, the heat of the fuse element 3 may be transferred to the glass tube 2 and fusion of the fuse element 3 may be delayed.

Further, since the solder 5 is filled and directly fixed between the inner surface of the cap terminal 7 and the end surface of the glass tube 2, the inside of the glass tube 2 is sealed to disable ventilation when the cap terminal 7 is heated in order to melt the solder 5 provided on the inner surface of the cap terminal 7 and to fix the solder 5 to the fuse element 3, the cap terminal 7 and the glass tube 2. An increase in the pressure inside the glass tube 2 causes application of the melted solder to be uneven so that the ununiformity be generated at a position where the solder 5 is attached to the fuse element 3, and the length of the exposed part of the fuse element 3 thereby becomes unequal to give the irregularity to the pre-arcing time/current characteristic. Also, in some cases, the solder 5 can not be attached and fixed to the fuse element 3 on the edges of the glass tube 2, and the fuse element 3 is in direct contact with the glass tube 2, i.e., the fuse element 3 can not be supported by the solder, which may damage the bent portions of the fuse element 3 or cause disconnection due to fatigue of a metal. Since the inside of the glass tube 2 is sealed, an increase in the inner pressure owing to explosion of the element can not be released at the time of interruption caused due to a short-circuit accident or the like, and the glass tube 2 may explode or the cap terminal 7 may be blown out. The strength of the glass tube 2 or the joining force of the cap 7 must be considerably increased.

Furthermore, since the cap terminal 7 is fitted with the both ends of the fuse element 3 being stretched in the opposed directions along the diameter direction on the edges of the glass tube 2 in order to sandwich the both ends between the glass tube 2 and the cap terminal 7, the relatively-large cap terminal 7 is inclined to the glass tube 2 and can not be concentrically provided with respect to the glass tube 2. In particular, this tendency becomes prominent as the wire diameter of the fuse element 3 increases. The positions of the cap terminals 7 provided on both sides are, therefore shifted with respect to the glass tube 2 in the opposed directions along the diameter direction by the thickness of the fuse element 3. As shown in FIG. 13, when the tubular fuse 6 is fitted to fuse clips, the point contact causes each cap terminal 7 to be heated and softens the hard solder 5 to loosen the stretched fuse element 3, and the fuse element 3 is brought into contact with the glass tube 2, which leads to an imperfect fusion or the melted fuse clips.

Moreover, when mounting the tubular fuse 1 shown in FIG. 11 or the tubular fuse 6 shown in FIG. 12 on, e.g., a printed wiring board as a fuse with a lead wire, such a fuse may be supplied to a solder tank of a reflow furnace or the like and thereafter soldered on the printed wiring board. In this case, if the temperature management of the reflow furnace or the like is poor, the solder layer 5 fixing the fuse element 3 becomes soft when the tubular fuse is heated, the stretched fuse element 3 may be loosened to be brought into contact with the glass tube 2.

It is, therefore, an object of the present invention to facilitate automation of the process and provide a reliable fuse.

DISCLOSURE OF THE INVENTION

To achieve this aim, a fuse according to the present invention is characterized in that: an inner cap fixed to a non-conductive tubular housing body is provided between the tubular housing body and a cap terminal which blocks an end portion of the tubular housing body; a passage for ventilating the inside of the tubular housing body is provided between the inner cap and the tubular housing body; an end portion of a fuse element is taken out between the cap terminal and the inner cap through an element insertion hole formed substantially in the center of a bottom plate of the inner cap and electrically connected at least to the cap terminal; and the cap terminal is fixed to the inner cap.

Therefore, a double cap is fitted on the end portion of the tubular housing body so that a means for fixing the cap terminal to the inner cap, for example, the solder can spread between the end portion and the cap, and the inside of the tubular housing body is ventilated to enable a passage for avoiding an increase in pressure to be formed. Further, the cap terminal covers the solder (fixing member) blocking the inner cap and the fuse element, and hence the blowout can be prevented from occurring due to the explosion energy of the interruption even though a thin part is made in the solder. This facilitates automation of the manufacturing process and prevents an increase in pressure in the tubular housing body to avoid damage. In addition, although the fuse element is stretched between the inner caps fitted at both the ends of the tubular housing body, both the ends of the fuse element are inserted into the element insertion holes each formed at a position corresponding to substantially the center of the glass tube and thus the fuse element is arranged sufficiently distant from the tubular housing body. Since the fuse element can be set sufficiently apart from the tubular housing body, the heat of the fuse element can not be transferred to the tubular housing body to avoid delay of fusion of the fuse element, thereby improving reliability of the fuse. Furthermore, arrangement of the fuse element distant from the tubular housing body can prevent the damage from being given to the fuse element due to a contact made between the fuse element and the end surface or the like of the tubular housing body when assembling the fuse element, providing the fuse suitable for automation of the manufacturing process.

The inner cap and the cap terminal according to the present invention are fixed by a fixing means. Although a brazing material such as a solder, a conductive adhesive agent or the like can be exemplified as this fixing means, the brazing material and the solder in particular can be preferably used. In this case, the solder is accommodated on the bottom of the cap terminal in advance and melted by heating after the cap terminal is fitted on the inner cap in order to fix the cap terminal, the fuse element and the inner cap with each other. Therefore, when manufacturing the fuse, soldering can be effected by only heating using a heater or a high-frequency induction furnace after assembling all the constituent parts of the fuse. The solder spreads between the cap terminal and the inner cap to electrically connect the cap terminal, the inner cap and the fuse element. This can provide a fuse suitable for automation of the process, thereby contributing to improvement of the productivity.

Additionally, according to the present invention, the cap terminal and the inner cap are joined to each other by press fitting. In this case, the fuse can be manufactured by simply press-fitting the cap terminal on the inner cap with each end portion of the fuse element being fixed to the inner cap. The fuse can be, therefore, suitable for automation of the assembling work to easily intend improvement of the productively, and reliability of the fuse can be enhanced.

Moreover, each end portion of the fuse element of the fuse is bent along the outer side surface of the inner cap and caught by the inner cap in such a manner that the end portion is positioned and fixed between the inner cap and the cap terminal. In this case, when manufacturing the fuse, the cap terminal can be assembled with the end portion of the fuse element being temporarily fixed. After assembling, the cap terminal and the fuse element are brazed or bonded to the inner cap to complete the production of the fuse. Therefore, automation of the fuse assembling work can be facilitated to improve the productivity.

Further, in the fuse according to the present invention, each end portion of the fuse element is sandwiched and temporarily fixed between the bottom plate of the inner cap and the cap. When manufacturing the fuse, the cap terminal can be thus assembled with each end portion of the fuse element being fixed in the inner cap, and the cap terminal is brazed or bonded in the inner cap after the assembling work, completing the production of the fuse. As similar to the above-described example, automation of the process can be thus facilitated and improvement of the productivity can be easily intended.

In the fuse according to the present invention, each end portion of the fuse element is fixed to the bottom plate of the inner cap. Although spot welding, brazing, laser welding, fixing using a conductive adhesive agent and others can be exemplified as this fixing means, application of spot welding is preferable especially. In this case, with each spot electrode being put on the inner cap, flowing the electric current between the respective spot electrodes ensures the fuse element to be fixed and electrically connected to the inner cap. That is, fuse element can be easily fixed to the inner cap to further improve the productivity. Since a joint part of the fuse element and the inner cap fixed by the spot welding has a melting point higher than that obtained by soldering, the fuse element can not be loosened even though the heat management of the solder tank is poor and the solder is softened. It is preferable that the position to which the end portion of the fuse element is fixed is the bottom plate of the inner cap and that it is an inclined surface of the bottom plate depressed toward the tubular housing body in particular. In this case, when the tubular housing body is inclined toward the fuse element with the fuse element being inserted into the tubular housing body having the inner cap fixed thereto at the both ends, the fuse element is brought into contact with the inclined surface of the bottom plate of the inner cap. That is, the fuse element can become parallel with the bottom plate of the inner cap without being largely bent. Therefore, it is possible to suppress fatigue of a metal generated at a bent part by a temperature cycle which repeatedly affects on the fuse element, thus improving durability and reliability of the fuse.

In addition, fixation of the fuse element to the inner cap and fixation of the cap terminal to the inner cap can be done by using different means. The fuse element can be, therefore, successfully fixed to the inner cap even though the fixed state of the cap terminal with respect to the inner cap becomes loose, preventing the fuse element from being loosened.

Furthermore, in the fuse according to the present invention, a part of the fuse element which is close to the tip from the fixing position to the inner cap is positioned in the vicinity of the indent of the bottom plate of the inner cap. Accordingly, the part of the fuse element which is close to the tip from the fixing part to the inner cap does not enter the space between the outer peripheral surface of the inner cap and the inner peripheral surface of the cap terminal, and the inner cap, the cap terminal and the glass tube can be concentrically arranged. Thus, the fuse can be straightly mounted to the fuse clips, and their contact area can be sufficiently assured, thereby obtaining the good conductive state.

Moreover, in the fuse according to the present invention, the ventilation passage between the inner cap and the tubular housing body is sealed by the solder flowed out from the element insertion hole formed on the bottom plate of the inner cap. In this case, production of a micro-fuse can be automated.

BEST MODES FOR EMBODYING THE INVENTION

The structure of the present invention will now be described in detail hereunder in connection with illustrative best modes.

Figure 1:
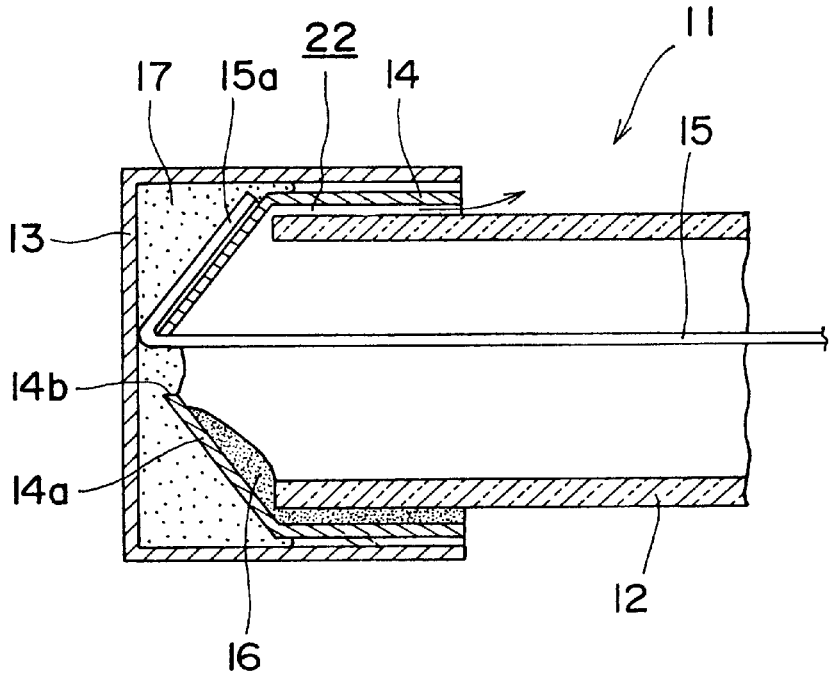
FIG. 1 is a cross-sectional view showing a primary part of a first embodiment of a tubular fuse to which the present invention is applied.

FIG. 1 shows a first embodiment of a tubular fuse according to the present invention. The tubular fuse 11 is mounted to non-illustrated fuse clips to be used and comprises: a non-conductive tubular housing body, e.g., a glass tube 12; an inner cap 14 adhered to each of both ends of the glass tube 12; a cap terminal (external cap) 13 fitted on the inner cap 14 to function as a fuse terminal; a fuse element 15 having both ends each taken out between the cap terminal 13 and the inner cap 14 and caught by the inner cap 14; and a means for electrically connecting the inner cap 14 and the cap terminal 13, i.e., solder 17, with a ventilation passage 22 being provided between the inner cap 14 and the glass tube 12.

That is, as similar to the cap terminal 13, the inner cap 14 is conductive and a bottom plate 14*a* thereof is molded into a conical shape whose head portion is cut off. In other words, the bottom plate 14*a* of the inner cap 14 conically protrudes towards the outside of the glass tube 12. An element insertion hole 14*b* is formed on the inner cap 14 at a position apart from the glass tube 12, i.e., substantially in the central position of the bottom plate 14*a*. The element insertion hole 14*b* is formed to be sufficiently large as compared with the fuse element 15.

The inner cap 14 is fitted on an end of the glass tube 12 and fixed by an adhesive agent 16. The adhesive agent 16 is applied on a predetermined area of the glass tube 12 in the circumferential direction, e.g., an area corresponding to approximately ⅔ of the same. Therefore, in a part where no adhesive agent 16 is applied, a gap is generated between the inner cap 14 and the glass tube 12, and this gap serves as the ventilation passage 22 for ventilating the inside of the glass tube 12. However, the area on which the adhesive agent 16 is applied is not restricted to that described above, and it can be any area as long as a passage area which can prevent the inner cap 14 from falling and is sufficient for ventilating the inside of the glass tube 12 can be obtained. Also, it is needless to say that the adhesive agent 16 may be applied on several points so as to form dots or lines.

A fuse element (fusible metal wire material) 15 is obtained by applying, e.g., silver plating on copper and housed in the glass tube 12. An end portion 15*a* of the fuse element 15 is taken out between the cap terminal 13 and the inner cap 14 through the element insertion hole 14*b* of the inner cap 14 and sharply bent along the outer peripheral surface of the bottom plate 14*a* of the inner cap 14. As the fuse element 15, those having various kinds of composition or structure can be appropriately selected in accordance with the application of the fuse.

The cap terminal 13 for covering the end portion of the glass tube 12 is fitted on the inner cap 14 and fixed to the inner cap 14 together with the end portion 15*a* of the fuse element 15 by, e.g., soldering. That is, a solder which is heated and melted after the cap terminal 13 is fitted on the inner cap 14 and spreads between the cap terminal 13 and the inner cap 14 is provided inside the cap terminal 13. This ensures the end portion 15*a* of the fuse element 15 to be electrically connected with the cap terminal 13 and the inner cap 14.

It is to be noted that the inner cap 14 and the cap terminal 13 are fitted to each of both the ends of the glass tube 12 and support the both end portions 15*a* of the fuse element 15. Further, the glass tube 12 is so set as to have predetermined length and diameter in compliance with standards required by consumer countries, users and others.

The tubular fuse 11 is manufactured in the following manner.

The respective inner caps 14 are first fitted on the both end portions of the glass tube 12 and fixed by using the adhesive agent 16. The fuse element 15 is then inserted through the element insertion hole 14*b* of the inner cap 14, and both the end portions 15*a* of the fuse element 15 are bent along the conical bottom plate 14*a*. Here, the fuse element 15 which is so cut to a desired length in advance may be prepared, or it may be continuously drawn out and cut by a bending means. Since the fuse element 15 has rigidity to some extent and plastically deforms when bent in the substantially-V shape, the fuse element 15 is temporarily fixed in such a manner that it is stretched between the respective inner caps 14. That is, in this state, the fuse element 15 does not come off unless it receives a large external force, and the cap terminal 13 can be fitted with the fuse element 15 being stretched as will be described later.

On the other hand, a predetermined amount of solder 17 is put on the inside of the cap terminal 13 in advance. This cap terminal 13 is then fitted on the inner cap 14 having the fuse element 15 being temporarily fixed thereto and the circumference of the cap terminal 13 is heated. The solder 17 inside the cap terminal 13 is melted by heating and spreads between the cap terminal 13 and the inner cap 14 to fix the cap terminal 13 and the fuse element 15 to the inner cap 14.

In this manner, soldering can be effected by melting a predetermined amount of the solder 17 supplied in advance by utilizing an external heat source after assembling the respective constituent parts, and hence automation of the assembling work can be facilitated. Further, when automating the work, since the fuse element 15 is stretched between the respective inner caps 14 to fix both the ends, it is possible to prevent a damage due to contact with the end surface of the glass tube 12 from occurring. Moreover, the aim of the invention can be assuredly achieved because soldering is performed for only filling the space between the cap terminal 13 and the inner cap 14, and covering the outside with the cap terminal 13 does not lead to the blowing of the fuse at the time of interruption explosion even though a thin part is formed on the film of the solder 17.

In addition, since the element insertion hole 14*b* of the inner cap 14 is largely formed for the fuse element 15, the fuse elements 15 having various kinds of thickness can be used to the same inner cap 14, the cap terminal 13 and the glass tube 12.

In this tubular fuse 11, since the fuse element 15 can be arranged substantially in the center of the glass tube 12 sufficiently apart from the glass tube 12 by the inner cap 14, the fuse element 15 can be prevented from coming into contact with the glass tube 12, and the heat of the fuse element 15 can not be transferred to the glass tube 12 when the current flows, thereby avoiding the imperfect fusion of the fuse element 15 when a current value reaches a specified current value.

Further, the inside of the glass tube 12 is ventilated through the passage 22 as described above. This can prevent the pressure inside the glass tube 12 from abnormally increasing to avoid a damage given on the glass tube 12 when the over current flows through the tubular fuse 11 to cause the fuse element 15 to instantaneously have a high temperature and to be fused (interruption explosion).

Figure 2:
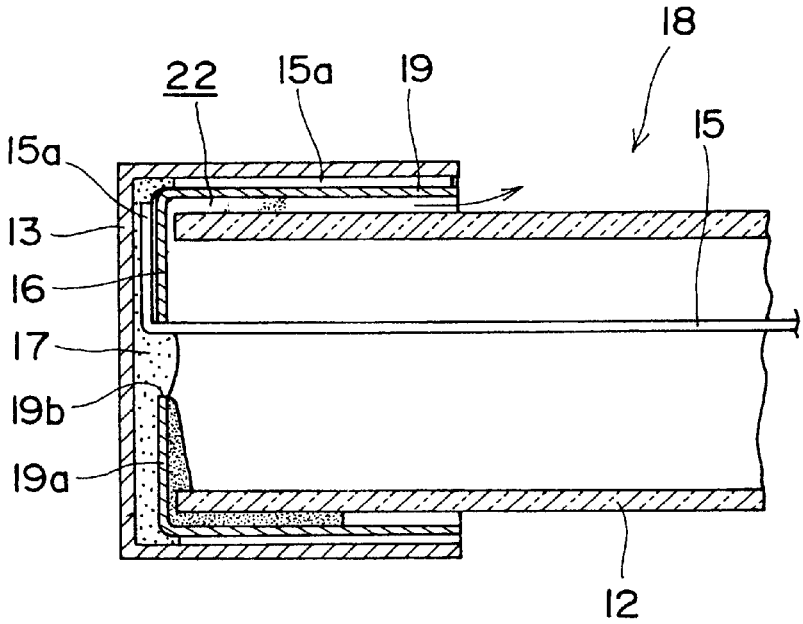
FIG. 2 is a cross-sectional view showing a primary part of a second embodiment of the tubular fuse to which the present invention is applied.

FIG. 2 shows another embodiment of the tubular fuse according to the present invention. In the fuse 18 according to this embodiment, the bottom plate 14*a* of the inner cap 14 is not molded into a conical shape whose head portion is cut off but formed to have a flat surface. In case of this tubular fuse 18, there is adopted the inner cap 19 whose bottom plate 19*a* has a flat disc form, and both the ends of the fuse element 15 are bent at a right angle so that the fuse element 15 be caught by the bottom plate 19*a* of the inner cap 19. The fuse element 15 is sandwiched between the bottom plate 19*a* of the inner cap 19 and the bottom of the cap terminal 13 after melting the solder 17. Therefore, the fuse element 15 can not be loosened even when the solder 17 is slightly melted and softened by the heat from the reflow furnace at the time of mounting the fuse.

Figure 3:
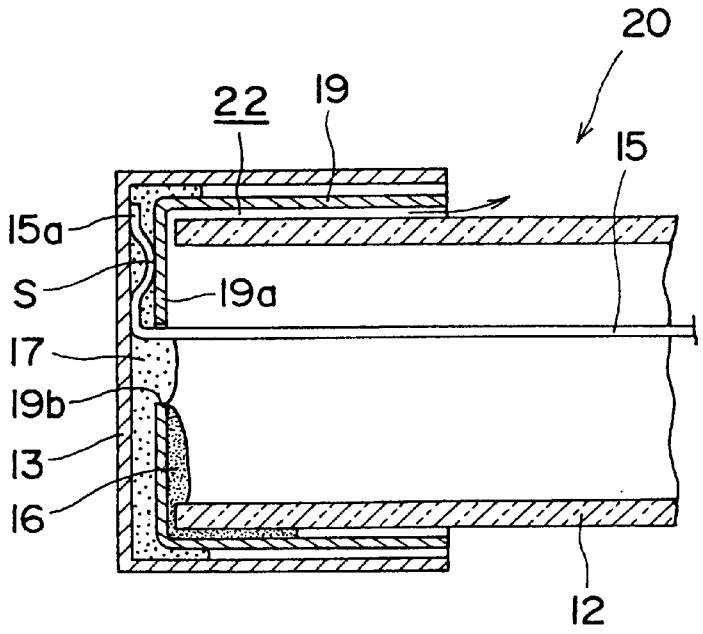
FIG. 3 is a cross-sectional view showing a primary part of a third embodiment of the tubular fuse to which the present invention is applied.

FIG. 3 shows a third embodiment according to the present invention. The fuse 20 according to this embodiment has such a structure as that the end portion 15*a* of the fuse element 15 is previously fixed to the bottom plate 19*a* of the inner cap 19 before fitting the cap terminal 13 to the inner cap 19. As a method for fixing the end portion 15*a* of the fuse element 15 to the inner cap 19, it is possible to adopt, e.g., spot welding using an inverter spot welder or a transistor spot welder, welding using a laser beam to be irradiated, or fixing using a conductive adhesive agent. It is, however, necessary that the fixed state must not be cancelled at a temperature higher than a melting point of the solder 17. It is to be noted that reference character S in the drawing designates a point where the spot welding is carried out.

Figure 4:
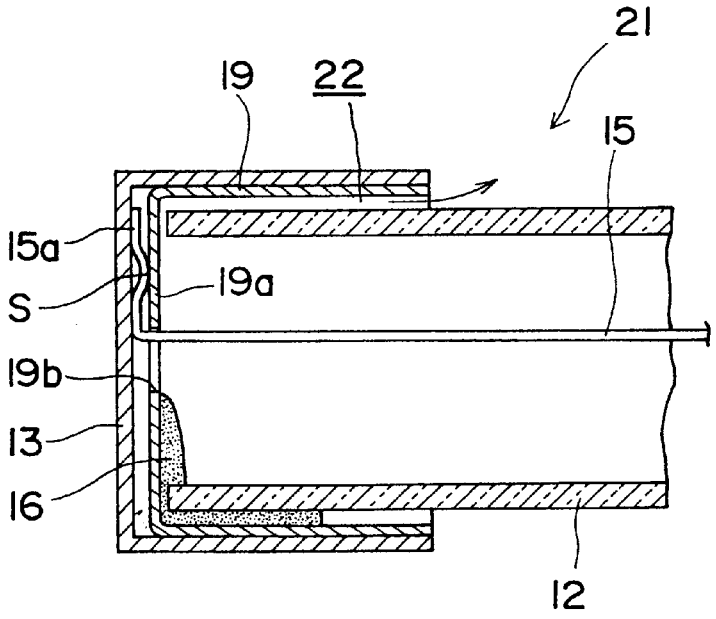
FIG. 4 is a cross-sectional view showing a primary part of a fourth embodiment of the tubular fuse to which the present invention is applied.

Soldering does not have to be used to join the cap terminal 13 with the inner cap 19, and as shown by, e.g., the tubular fuse 21 in FIG. 4, the cap terminal 13 may be press-fitted to be fixed to the inner cap 19 whose bottom plate 19*a* has the end portion 15*a* of the fuse element 15 spot-welded thereto. In this case, a space, to which no adhesive agent 16 is applied, between the inner cap 19 and the glass tube 12 may serve as the passage 22, or a groove may be provided on the inner surface of the cap terminal 13 or the outer surface of the inner cap 19 to form the passage 22 between the cap terminal 13 and the inner cap 19.

Although the element insertion holes 14*b* and 19*b* are formed substantially in the center of the bottom plates 14*a* and 19*a* in the above respective inner caps 14 and 19, positions at which the element insertion holes 14*b* and 19*b* are formed are not restricted to the center of the bottom plates 14*a* and 19*a* and they can be of course formed at positions shifted from the center as long as the fuse element 15 can be arranged sufficiently apart from the glass tube 12.

The above has described that the soldering is a method for fixing the cap terminal 13 to the inner caps 14 and 19, but the method is not restricted to the soldering and a brazing, a conductive adhesive agent or the like may be used. That is, the brazing or the conductive adhesive agent, which spreads between the cap terminal 13 and the inner caps 14 and 19 after the cap terminal 13 is fitted on the inner caps 14 and 19, may be provided inside the cap terminal 13 before fitting the cap terminal 13 to the inner caps 14 and 19.

It is preferable that the inner caps 14 and 19 are conductive but do not have to be conductive.

Furthermore, although the end portion 15*a* of the fuse element 15 is electrically connected to the cap terminal 13 and the inner cap 14 by soldering in the above description, the end portion 15*a* may be electrically connected at least to the cap terminal 13.

Figure 5:
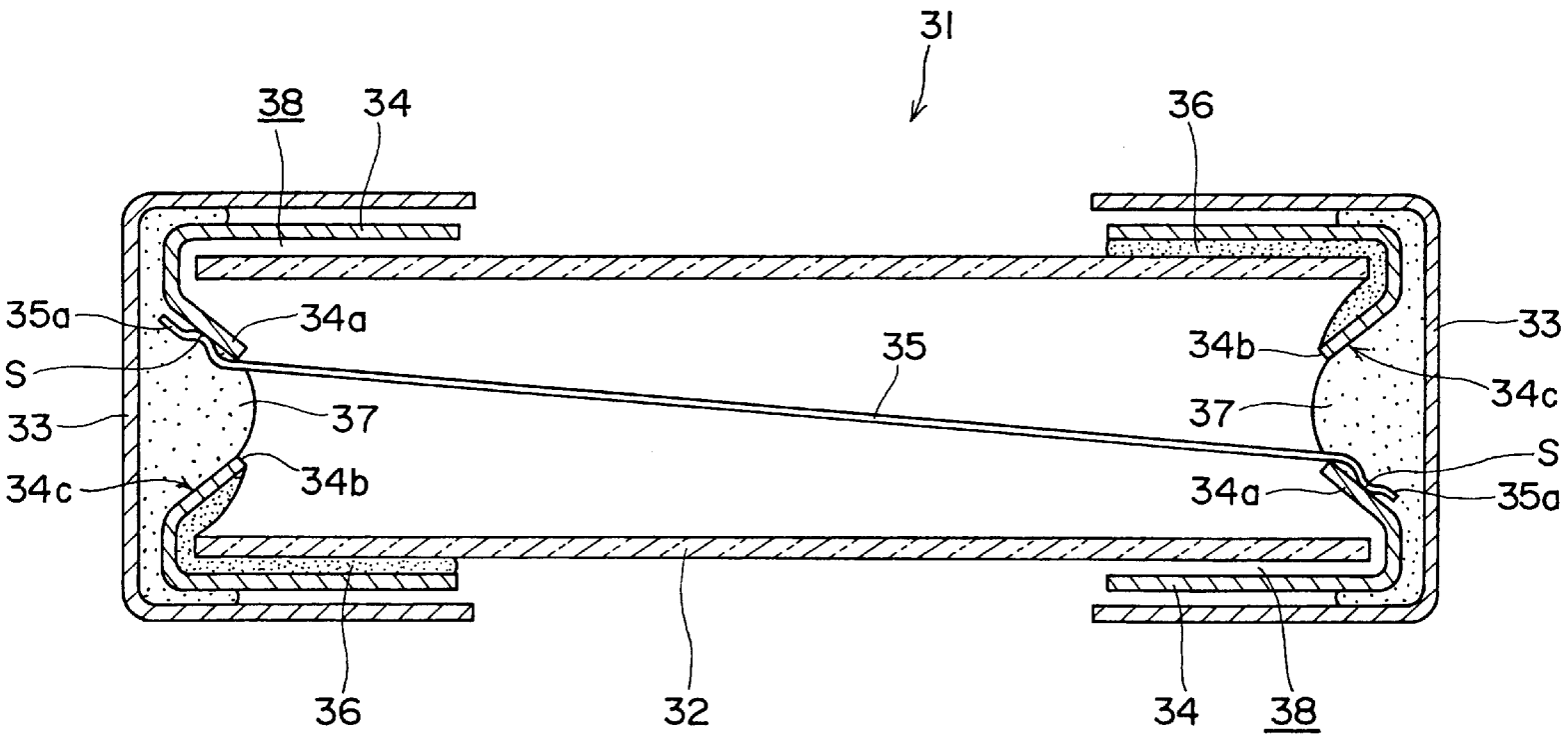
FIG. 5 is a cross-sectional view showing a fifth embodiment of a fuse to which the present invention is applied.

FIG. 5 shows a fifth embodiment of a fuse according to the present invention. In the tubular fuse 31 of this embodiment, the bottom plate 34*a* of the inner cap 34 conically protrudes toward the inside of the glass tube 32 to form an indent on the bottom of the inner cap 34. In other words, the bottom plate 34*a* of each inner cap 34 conically protrudes toward the glass tube 32 to form an inclined surface 34*c*. The end portion 35*a* of the fuse element 35 is fixed to this inclined surface 34*c* by, e.g., spot welding. However, the fixing method is not necessarily limited to the spot welding and it may be, e.g., fixing using a conductive adhesive agent or brazing. In addition, a part of the fuse element 35, which is close to the tip from a fixing position S with respect to the inner cap 34, is cut short and set inside the outer diameter of the bottom plate 34*a* of the inner cap 34 for example. The part of the fuse element 35, which is close to the tip from the fixing position S with respect to the inner cap 34, does not project toward the outer peripheral side of the inner cap 34.

It is to be noted that the cap terminal 33 is fixed to the inner cap 34 by the solder 37. However, the method for fixing the cap terminal 33 to the inner cap 34 is not limited to the solder 37, and a conductive adhesive agent or the like may be used. When brazing is used to fix the end portion 35*a* of the fuse element 35 to the inclined surface 34*c* and fix the cap terminal 33 to the inner cap 34, it is preferable that a brazing material for joining the fuse element 35 to the inner cap 34 has a melting point higher than that of a brazing material for joining the cap terminal 33 to the inner cap 34.

This fuse 31 is manufactured in the following manner, for example.

In the first place, the inner cap 34 is respectively fitted to both the ends of the glass tube 32 and the adhesive agent 36 is used to fix them. In this case, adjusting a fitting quantity of the inner cap 34 can absorb the irregularity in length of the glass tube 32 to make the length of the fuse 31 uniform.

Figure 6:
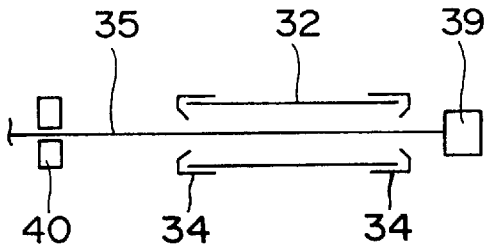
FIG. 6 is a schematic structural view showing a part of the process for manufacturing the fuse illustrated in FIG. 5, with a fuse element being inserted into a glass tube and each inner cap.
Figure 7:
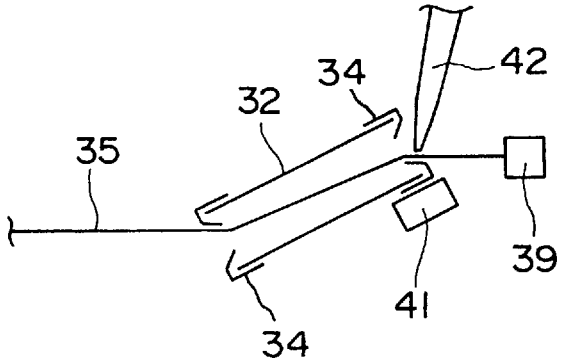
FIG. 7 is a schematic structural view showing a part of the process for manufacturing the fuse illustrated in FIG. 5 in order to explain how to spot-weld the fuse element to the inner cap.
Figure 8:
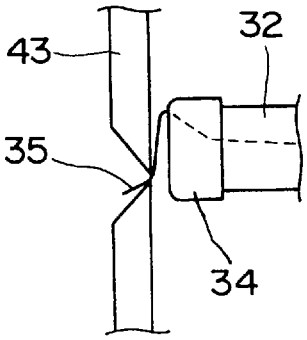
FIG. 8 is a cross-sectional view showing a primary part of a sixth embodiment of the fuse to which the present invention is applied.
Figure 9:
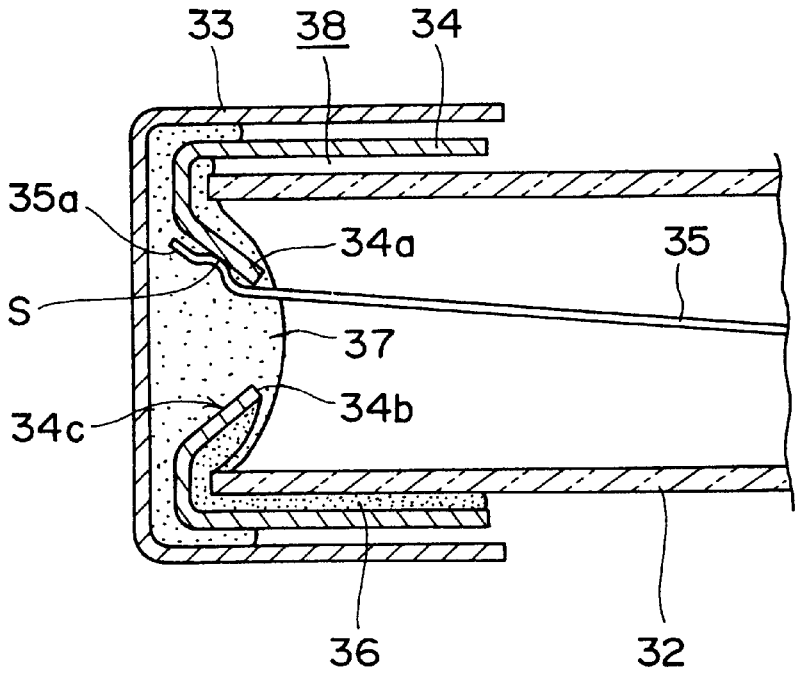
FIG. 9 is a cross-sectional view showing a primary part of a seventh embodiment of a fuse to which the present invention is applied.
Figure 10:
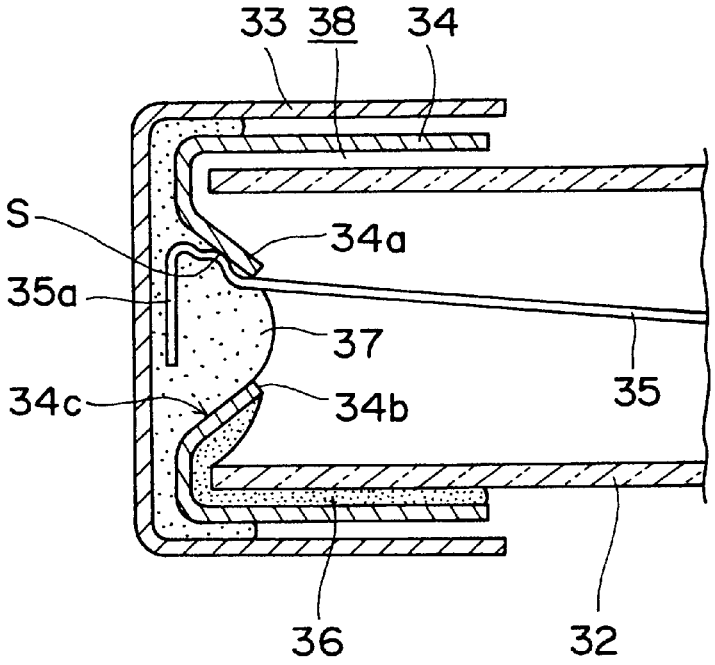
FIG. 10 is a schematic structural view showing a part of the process for manufacturing the fuse illustrated in FIG. 9 in order to explain how to bend an end of the fuse element.
Figure 11:
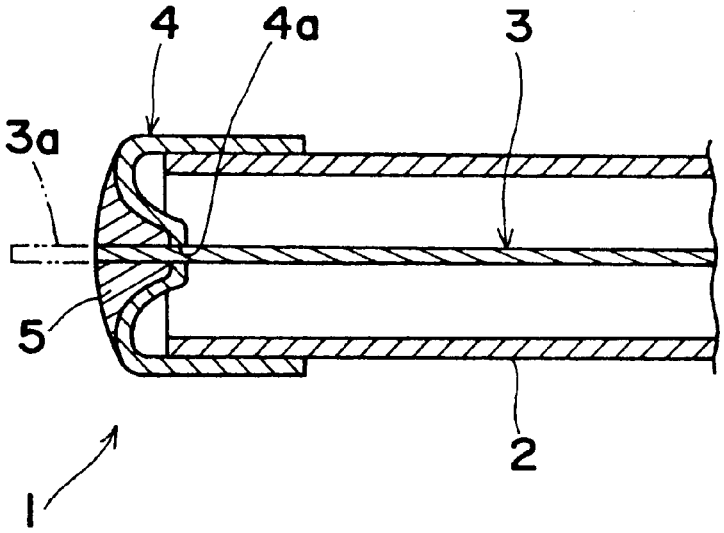
FIG. 11 is a cross-sectional view of a prior art tubular fuse.
Figure 12:
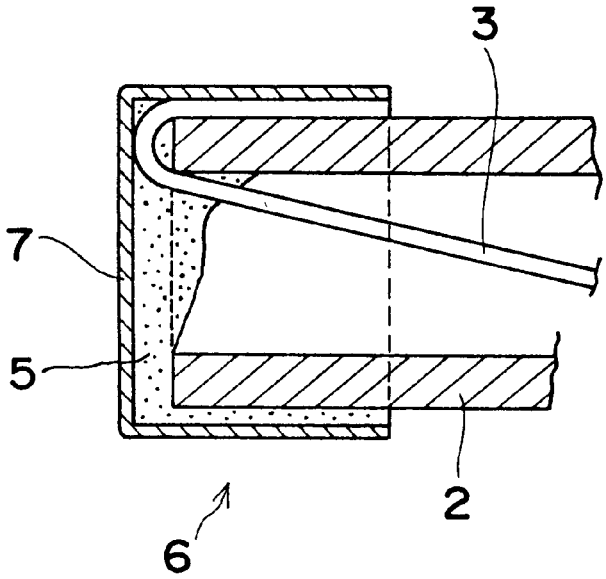
FIG. 12 is a cross-sectional view of another prior art tubular fuse.
Figure 13:
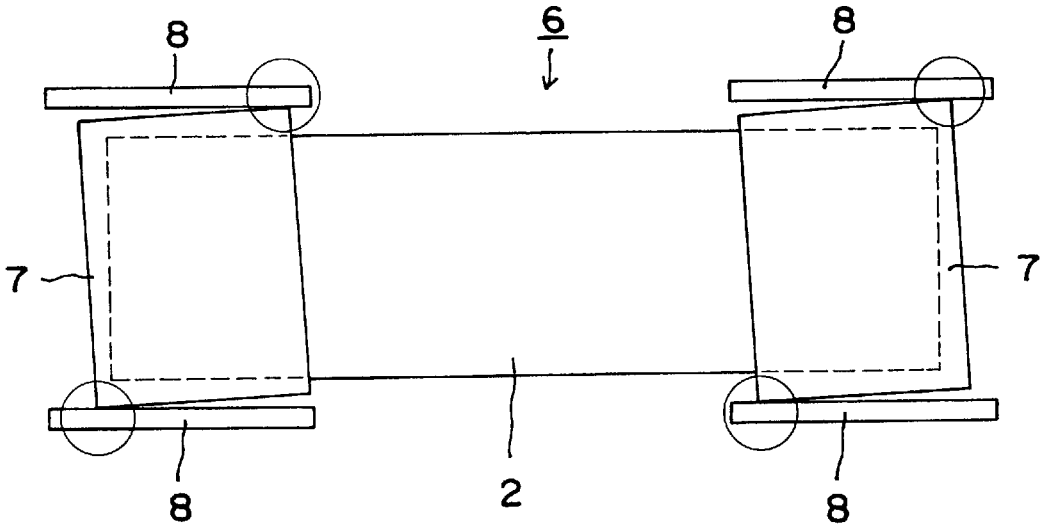
FIG. 13 is a plan view in which the tubular fuse illustrated in FIG. 12 is mounted to fuse clips.

The fuse element 35 is then inserted through the element insertion hole 34*b* of each inner cap 34 and the glass tube 32. As shown in FIG. 6, the fuse element 35 is gripped by chucks 39 and 40 and stretched straightly. Subsequently, the glass tube 32 is inclined with respect to the fuse element 35 and the fuse element 35 is brought into contact with the bottom plate 34*a* of the inner cap 34 in parallel with each other as shown in FIG. 7. In this state, one spot electrode 41 is put on the outer peripheral surface of the inner cap 34 and the other spot electrode 42 is put on the fuse element 35 to perform the spot welding. This ensures the fuse element 35 to be fixed to the conductive inner cap 34 so that they can be electrically connected to each other. Then, with a tension being applied to the fuse element 35, the part of the fuse element 35 which is close to the tip from the fixing position S relative to the inner cap 34 is cut. At this time, the part of the fuse element 35 which is close to the tip from the fixing position S is shortened by cutting the part close to the fixing position S and it is thus arranged inside the indent of the bottom plate 34*a* of the inner cap 34. The structure is not restricted thereto and, as shown in FIG. 8, a cutter 43 for cutting the fuse element 35 may be used for bending the fuse element 35 inwardly so that the part of the fuse element 35 which is close to the tip from the fixing position S can be accommodated inside the outer diameter of the bottom plate 34 of the inner cap 34, or more preferably, it can be accommodated in the indent portion of the bottom plate 34*a*. That is, after the fuse element 35 is nipped by the cutter 43 to be bent and the cutter 43 is thereafter used to cut the fuse element 35, or after the cutter 43 is first used to cut the fuse element 35, the free end of the fuse element 35 can be pushed and bent by the cutter 43. In this case, the tip of the fuse element 35 is bent toward the center of the bottom plate 34*a* of the inner cap 34 so that it can be put inside the outer diameter of the bottom plate 34*a* as in the seventh embodiment illustrated in FIG. 9, which can prevent the cap terminal 33 from being inclined toward the inner cap 34. The spot welding and cutting are similarly applied to the end portion 35*a* of the fuse element 35 on the opposite side.

On the other hand, a predetermined amount of solder 37 is previously provided inside the cap terminal 33. The cap terminal 33 is then fitted on the inner cap 34 to which the fuse element 35 is fixed, and the lower cap terminal 33 is heated with the glass tube 32 being erected. As a heating method, there is a method using a heater or another method utilizing a high-frequency induction furnace, for example. The solder 37 inside the cap terminal 33 is melted by heating and spreads between the cap terminal 33 and the inner cap 34. At the same time, the solder 37 also moves to the glass tube 32 while pushing the gas in the glass tube 32 through the passage 38 and fills the gap between the cap terminal 33 and the inner cap 34 to fix them. This ensures the cap terminal 33, the inner cap 34 and the fuse element 35 to be electrically connected.

Here, if an amount of the solder 37 provided inside the cap terminal 33 in advance is determined so that the solder 37 can not flow out from the element insertion hole 34*b* of the bottom plate 34*a,* the fixed state of the fuse element 35 can be stable. That is, since the solder 37 is melted with the glass tube 32 being erected and the cap terminal 33 being positioned on the lower side, the height (liquid level) for impounding the melted solder 37 becomes constant, and the height of the exposed part of the fuse element 35 can be fixed. Further, the solder 37 flowed out from the element insertion hole 34*b* is stored inside the inner cap 34 by the gravity even if the amount of the solder 37 provided inside the cap terminal 33 is unequal to some extent, and the exposed portion of the fuse element 35 is not covered too much, thus making the length of the exposed portion of the fuse element 35 constant.

Further, after spot-welding the fuse element 35 to the inner cap 34 provided on each end of the glass tube 32, the cap terminal 33 is fitted and the soldering is performed by melting a predetermined amount of the solder 37 accommodated in the inside of the cap terminal 33 in advance by utilizing an external heat source when the assembling is completed, which facilitates automation of the process, improving the productivity. Further, the soldering is completed by filling the space between the cap terminal 33 and the inner cap 34, and hence the aim can be achieved. Even if a thin part is generated in the solder, it is covered with the cap terminal 33 and it can not be blown out by the breaking explosion.

Moreover, bubbles do not remain in the solder 37 and a cavity is prevented from being generated to maintain the good fixed state of the inner cap 34 and the cap terminal 33. When the work is automated, since the fuse element 35 is stretched between the respective inner caps 34, the fuse element 35 does not come into contact with the end surface of the glass tube 32, avoiding the damage. Therefore, the fuse 31 suitable for automating the manufacturing process can be provided.

As different from the soldering for fixing the cap terminal 33 to the inner cap 34, the end portion 35*a* of the fuse element 35 is fixed to the inclined surface 34*c* of the inner cap 34 by the spot welding, and hence the fuse element 35 can not be loosened even though the heat is applied and the hardened solder 37 is softened. For example, when embodied as a fuse having a lead wire, the fuse 31 is put on a printed wiring board or the like and sent to the reflow furnace in this state for the mounting process. Here, the solder 37 may be softened if the heat management of the solder tank is poor. However, according to the fuse 31 of this invention, since the end portion 35*a* of the fuse element 35 is fixed to the inner cap 34 by the spot welding even if the solder 37 is softened, the fuse element 35 can not be loose and the contact between the fuse element 35 and the glass tube 32 can be avoided. In addition, the fuse element 35 can be arranged sufficiently apart from the glass tube 32, and hence the fuse element 35 can be prevented from coming into contact with the glass tube 32 to assure the operation of the fuse 31, thereby improving the reliability.

Moreover, since the fuse element 35 is spot-welded to the inclined surface 34*c* of the inner cap 34, the fuse element 35 can be fixed to the inner cap 34 without largely bending the fuse element 35, the solder 37 can excellently spread to wrap the end portion 35 of the fuse element 35, and the temperature cycle repeatedly acting on the fuse element 35 can suppress fatigue of the metal generated in the bent portion, enhancing the durability and the reliability of the fuse 31.

Since the part of the fuse element 35 close to the tip from the fixing position S relative to the inner cap 34 is cut short and this part close to the tip is not sandwiched between the outer peripheral surface of the inner cap 34 and the inner peripheral surface of the cap terminal 33, the thick fuse element 35 such as a rush proof fuse (wound thick fuse) can be thus used, and automation of assembling process is also possible in this case.

Since the end portion 35*a* of the fuse element 35 is not sandwiched between the outer peripheral surface of the inner cap 34 and the inner peripheral surface of the cap terminal 33, the cap terminal 33, the inner cap 34 and the glass tube 32 can be concentrically arranged. This ensures the both cap terminals 33 to be coaxially provided, and they can be straightly mounted to the fuse clips, enabling their contact part to be a surface contact.

In this fuse 31, since the fuse element 35 can be provided substantially in the center of the glass tube 32 sufficiently apart from the glass tube 32 by the inner cap 34, the fuse element 35 can be prevented from coming into contact with the glass tube 32, and transfer of the heat from the fuse element 35 to the glass tube 32 can be avoided when turning on electricity, thereby evading the delay of fusion of the fuse element 35 when the current value reaches a specified current value.

Further, the inside of the glass tube 32 is ventilated through the passage 38 between the inner cap 34 and the glass tube 32 as described above. Therefore, even if the excess current flows to the fuse 31 due to a short-circuit accident or the like and fusion occurs so that the fuse element 35 may explode, the air in the glass tube 32 passes through the passage 38 to be emitted, and an abnormal increase in the pressure inside the glass tube 32 can not occur.

The above has described the preferred embodiments according to the present invention, but the invention is not restricted thereto, and various modifications and other embodiments are possible within the true scope and spirit of the invention.

For example, although description has been given mainly as to a fuse having a structure such that the ventilation passages 22 and 38 are provided between the glass tubes 12 and 32 and the inner caps 14 and 34 in the above respective embodiments, the invention is not restricted thereto. As in the seventh embodiment illustrated in FIG. 9, a sealed type fuse is also possible by making an amount of the solder 37 previously provided inside the cap terminal 33 larger than an amount of the solder 37 used in the fuse 31 shown in FIG. 5 and sealing the inside of the glass tube 32 after soldering the inner cap 34 and the cap terminal 33. This fuse is surface-mounted on the printed wiring board and generally referred to as a micro-fuse. This micro-fuse employs a small square tube made of ceramics instead of the glass tube and adopts the sealed structure in preparation for the cleaning process after the mounting process. Since the over current does not flow during the interruption because the fuse is used on the circuit side, i.e., the secondary side, the interruption explosion can not occur and the sealed structure can be used without hindrance. In this fuse, the solder 37 previously provided inside the cap terminal 33 is so determined as to have an amount such that the solder 37 flows out from the element insertion hole 34*b* and reaches to cover the ventilation passage 38 when the cap terminal 33 is fitted to the inner cap 34. With the cap terminal 33 being fitted on the inner cap 34 provided on each end to which the fuse element 35 is spot-welded, the glass tube 32 is erected and only the lower cap terminal 33 is heated. The melted solder 37 rises and fills the indent 34*a* on the bottom surface of the inner cap 34 while the gas in the glass tube 32 flows out from the ventilation passage 38, and the solder 37 overflows from the element insertion hole 34*b*. The overflowed solder 37 moves down on the inner surface of the inclined surface 34*c* of the inner cap 34 and flows into the passage 38. That is, the melted solder 37 flows to the inner side of the bottom plate 34*a* from the element insertion hole 34*b* to cover the passage 38. In this state, when the solder 37 is hardened, the inside of the glass tube 32 is sealed. Here, the solder 37 flows from the element insertion hole 34*b* of the bottom plate 34*a* toward the inner side of the bottom plate 34*a*, which fixes the fixing position S of the fuse element 35 relative to the inner cap 34 from both the inside and the outside, thereby further strengthening the fixing state between the fuse element 35 and the inner cap 34.

Further, the element insertion hole 34*b* does not have to be formed substantially in the center of the bottom plate 34*a* of the inner cap 34, and the element insertion hole 34*b* may be formed at an eccentric position of the bottom plate 34*a* as long as the fuse element 35 can be arranged sufficiently apart from the glass tube 32 or more preferably it can be inserted into the central position of the glass tube 32.

Although the glass tube is exemplified as the tubular housing body in this embodiment, the invention is not restricted thereto, and any non-conductive member can be used.

Moreover, the above has described the fuse which can be used when mounted to the fuse clips, but the fuse to which the present invention is applied is not restricted to this type of fuse, a wire leaded fuse which can be directly mounted on a printed wiring board or the like by directly connecting the lead wire to the cap terminal can be of course embodied.

We claim:

1. A fuse comprising:

a non-conductive tubular housing body;

a cap terminal covering an end portion of the tubular housing body;

an inner cap having a bottom plate, the inner cap being provided between the tubular housing body and the cap terminal, the inner cap being fixed to the tubular housing body;

a passage for ventilating an inside of the tubular housing body, the passage being provided between the inner cap and the tubular housing body and connecting the inside of the tubular housing body to an outside of said tubular housing body;

an element insertion hole formed substantially in a center of the bottom plate of the inner cap; and a fuse element having an end portion, the end portion of the fuse element being taken out between the cap terminal and the inner cap through the element insertion hole and being electrically connected at least to the cap terminal, while the cap terminal being fixed to the inner cap.

2. A fuse according to claim 1, wherein the inner cap and the cap terminal are fixed by a fixing means.

3. A fuse according to claim 2, wherein the fixing means is a solder which is provided on a bottom of the cap terminal in advance and melted by heating after fitting the cap terminal to the inner cap in order to fix the cap terminal, the fuse element and the inner cap with each other.

4. A fuse according to claim 1, wherein the cap terminal and the inner cap are fixed by press-fitting.

5. A fuse according to claim 1, wherein the end portion of the fuse element is bent along an outer peripheral surface of the inner cap and caught by the inner cap.

6. A fuse according to claim 1, wherein the end portion of the fuse element is sandwiched between the bottom plate of the inner cap and the cap terminal to be temporarily fixed.

7. A fuse according to claim 1, wherein the end portion of the fuse element is fixed to the bottom plate of the inner cap.

8. A fuse according to claim 7, wherein each of the inner caps has the bottom plate including an inclined surface depressed toward the inside of the tubular housing body and the end portion of the fuse element is fixed to the inclined surface.

9. A fuse according to claim 7, wherein the end portion of the fuse element is fixed to the bottom plate of the inner cap by spot welding.

10. A fuse according to claim 8, wherein a part of the fuse element close to a tip of the fuse element from a fixing position relative to the inner cap is positioned in a vicinity an indent of the bottom plate of the inner cap.

11. A fuse according to claim 1, wherein the ventilation passage between the inner cap and the tubular housing body is sealed by using solder flowed out from the element insertion hole formed on the bottom plate of the inner cap.

* * * * *